United States Patent [19]

Richardson

[11] 4,109,400

[45] Aug. 29, 1978

[54] SCRAPER UNLOADING SYSTEM

[75] Inventor: Warner G. Richardson, Joliet, Ill.

[73] Assignee: Caterpillar Tractor Co., Peoria, Ill.

[21] Appl. No.: 786,180

[22] Filed: Apr. 11, 1977

[51] Int. Cl.[2] ..... E02F 9/28; B60P 1/36

[52] U.S. Cl. ..... 37/126 AC; 37/129

[58] Field of Search ..... 37/124 R, 126 R, 126 A, 37/126 AC, 126 AE, 129, 8; 214/508

[56] References Cited

U.S. PATENT DOCUMENTS

| | | | |
|---|---|---|---|
| 3,108,388 | 10/1963 | Johnson | 37/126 R |
| 3,303,587 | 2/1967 | Rockwell | 37/129 X |
| 3,693,273 | 9/1972 | Sullivan | 37/129 |
| 3,934,362 | 1/1976 | Hyler | 37/8 |
| 4,020,574 | 5/1977 | Wagner | 37/129 X |

*Primary Examiner*—E.H. Eickholt

*Attorney, Agent, or Firm*—Phillips, Moore, Weissenberger, Lempio & Majestic

[57] ABSTRACT

The bowl assembly of a tractor scraper comprises a pair of laterally spaced sidewalls having a movable bowl portion pivotally mounted thereon to normally close an opening defined through a bottom of the bowl assembly. A double-acting cylinder, pivotally interconnected between one of the sidewalls and the bowl portion, is adapted to pivot the bowl portion to an open position. The cylinder is confined within the sidewall and is pivotally connected to the bowl portion via an arcuate slot formed through the sidewall. A sidewall of the bowl portion and a plate secured thereto function to continuously mask the slot during pivotal movement of the bowl portion between its open and closed positions.

9 Claims, 9 Drawing Figures

SCRAPER UNLOADING SYSTEM

BACKGROUND OF THE INVENTION

Earth moving scrapers are now in use in which the floor of the scraper is a pivoted platform adapted to be swung from a horizontal load sustaining position toward a vertical position in which the load of earth supported by it is dumped or discharged from the scraper bowl. Such a system is generally shown in U.S. Pat. Nos. 3,555,710 and 3,934,362, both assigned to the assignee of this application. In such apparatus, the overall vehicle will be seen to be a front engine vehicle, with the platform being moved through actuation of a cylinder extending rearwardly from the platform and adjacent the rear wheels of the vehicle.

In the case of a vehicle of the type having a rear engine, placed close to, for example, the rear wheels of the apparatus of U.S. Pat. No. 3,555,710, it will be seen that such rearwardly-placed cylinder could not be used, since it would interfere with the placement of the rear engine.

In addition, mounting of actuating cylinders for the platform within the bowl subjects the cylinders to possible damage and dirt accumulation which could adversely affect the operation thereof.

SUMMARY OF THE INVENTION

The present invention is directed to overcoming one or more of the problems as set forth above.

The bowl assembly comprising the present invention includes a pair of sidewalls and a bowl portion movably mounted thereon for movement between open and closed positions by an actuating means, disposed within the confines of one of the sidewalls. The actuating means is connected to the bowl portion through a slot formed through the one sidewall and masking means are provided for continuously covering the slot upon movement of the bowl portion between its open and closed positions.

BRIEF DESCRIPTION OF THE DRAWINGS

Other objects of the invention will become apparent from a study of the following specification and drawings, in which.

DESCRIPTION OF THE PREFERRED EMBODIMENT

Figure 7:
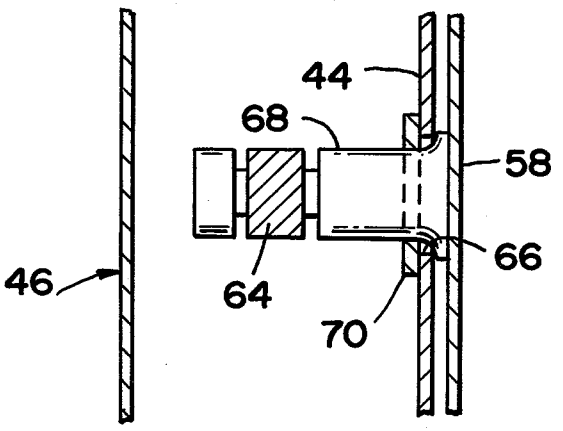
FIG. 7 is a sectional view taken along the lines VII—VII of FIG. 5.
Figure 9:
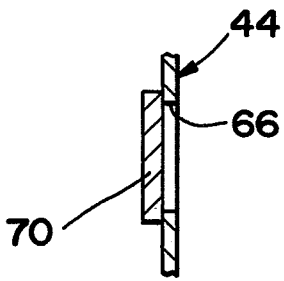
FIG. 9 is a sectional view taken along the lines IX—IX of FIG. 6.
Figure 8:
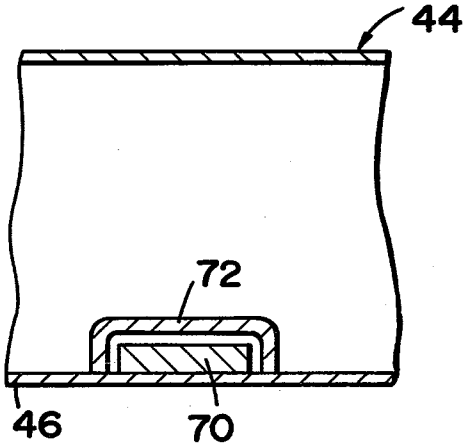
FIG. 8 is a sectional view taken along the lines VIII—VIII of FIG. 5.
Figure 1:
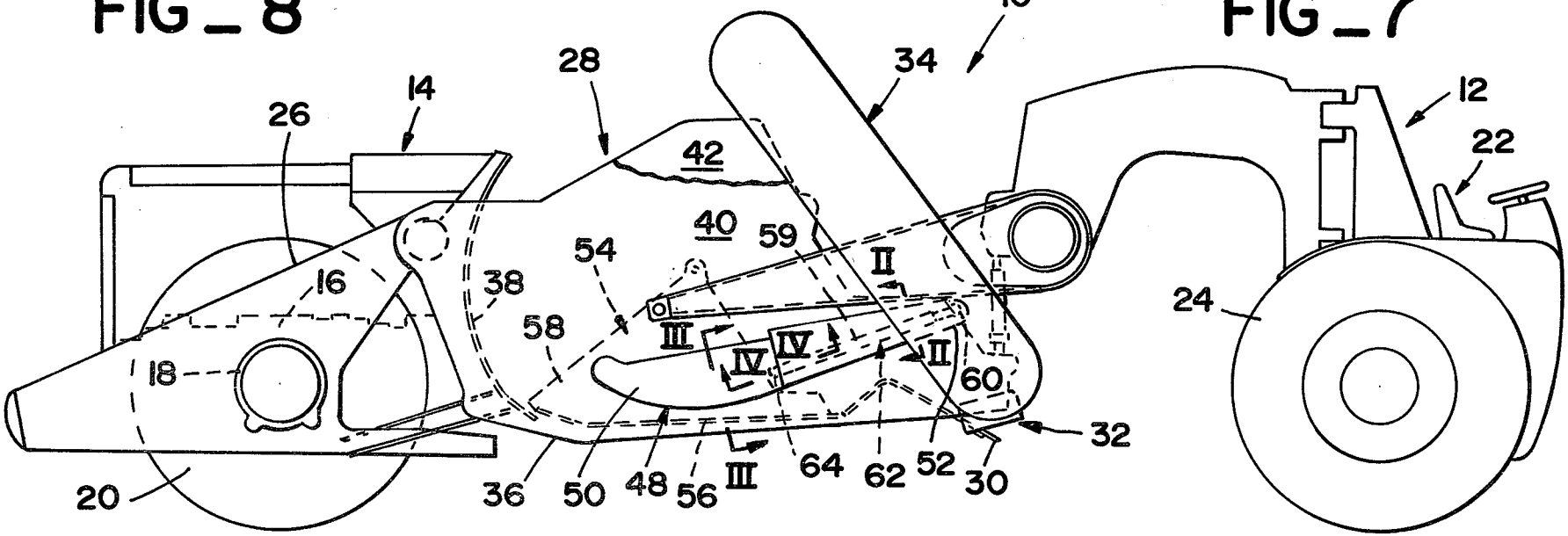
FIG. 1 is a view in side elevation of a scraper vehicle embodying the present invention.

Shown in FIG. 1 is a vehicle 10 (tractor scraper) including a forward portion 12 connected to a rearward portion 14, with the engine 16 and differential 18 of the vehicle 10 being mounted to the rearward portion 14, adjacent the rear wheels 20 thereof. Meanwhile, the operator's station 22 is connected to the forward portion 12 above the front wheels 24 of the vehicle 10. The rearward portion 14 of the vehicle 10 includes a frame 26, and a bowl assembly 28 operatively associated with the frame 26. Forwardly of the bowl assembly 28, a blade 30 is carried on a transverse blade support 32, and when the blade 30 is lowered into the ground by conventional means, a material elevator generally indicated at 34 is actuated to move the earth which is cut away from the ground by the blade 30 upwardly over the blade support 32 and into the bowl assembly 28.

The bowl assembly 28 includes a first fixed bowl portion 36, made up of a rear wall 38 and first and second spaced sidewall means 40, 42 secured relative to the frame 26. The constructions of the sidewall means 40 and sidewall means 42 are identical, one being reversed in position relative to the other, so only the construction of the sidewall means 40 will be described in detail.

Figure 2:
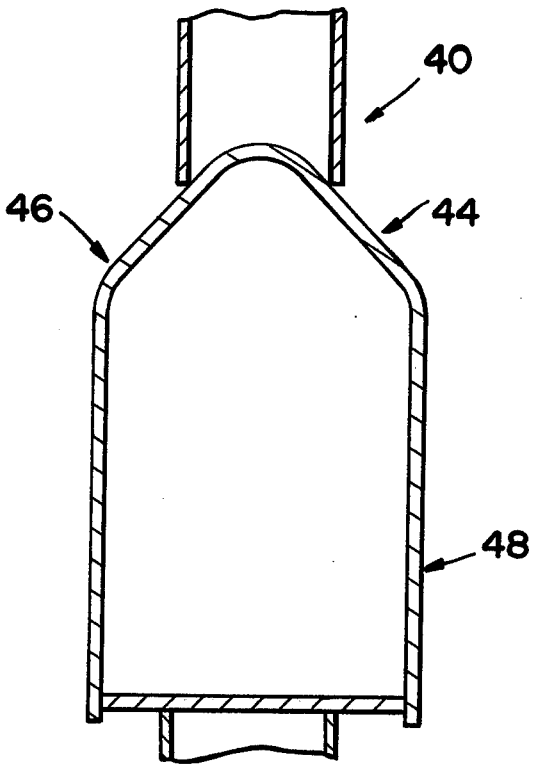
FIG. 2 is a sectional view taken along the lines II—II of FIG. 1.
Figure 3:
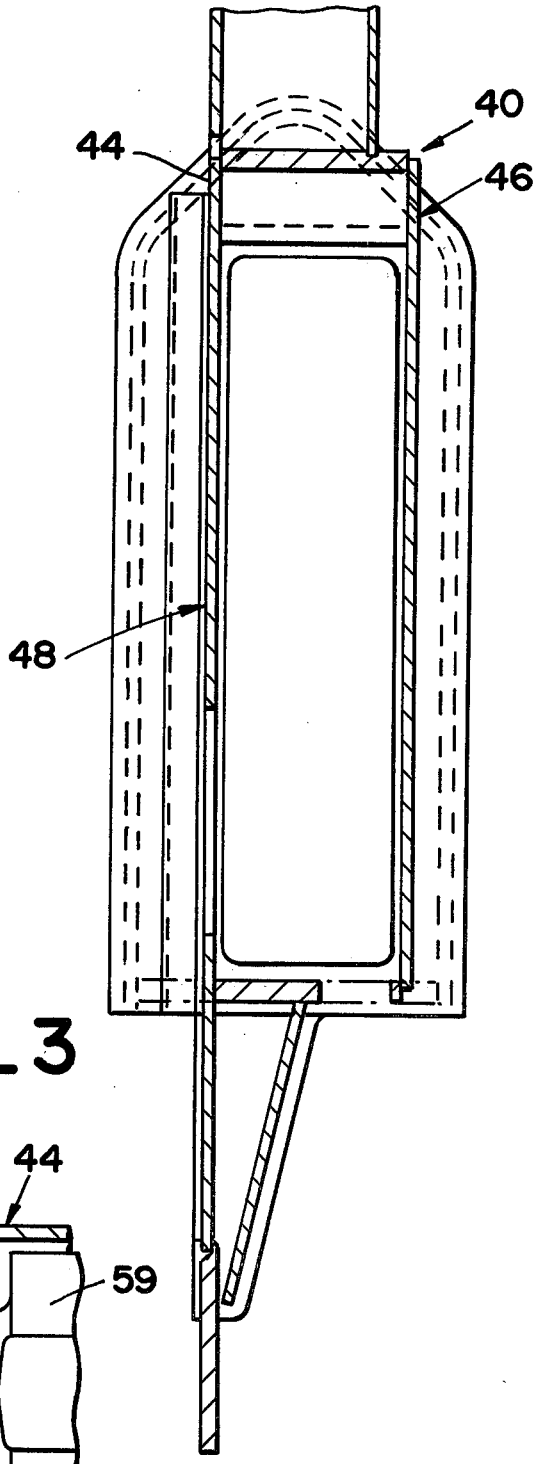
FIG. 3 is a sectional view taken along the lines III—III of FIG. 1.
Figure 4:
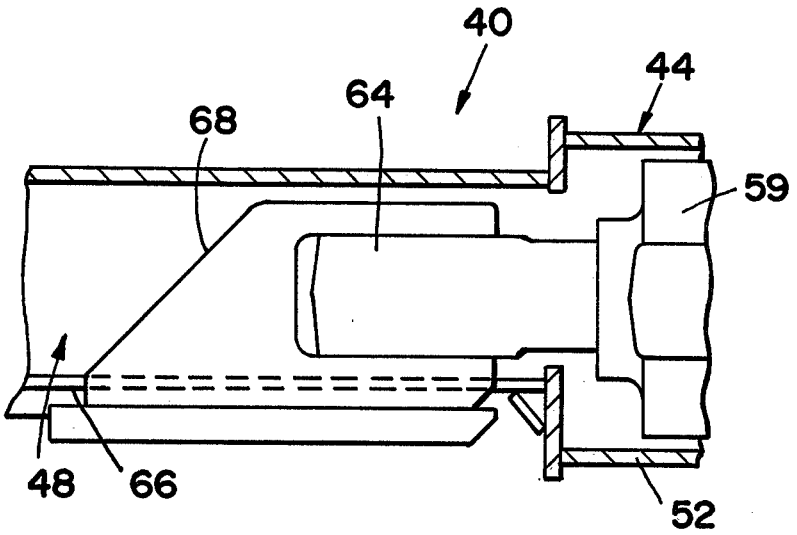
FIG. 4 is a sectional view taken along the lines IV—IV of FIG. 1.

As shown in FIGS. 2, 3 and 4, the sidewall means 40 are made up generally of a pair of spaced-apart sidewalls 44, 46, defining an elongated and tapered pocket portion 48. The width of the pocket portion 48 is actually stepped, being narrower in configuration adjacent the rear portion 50 thereof than the forward portion 52 thereof, as shown in FIG. 4.

Figure 5:
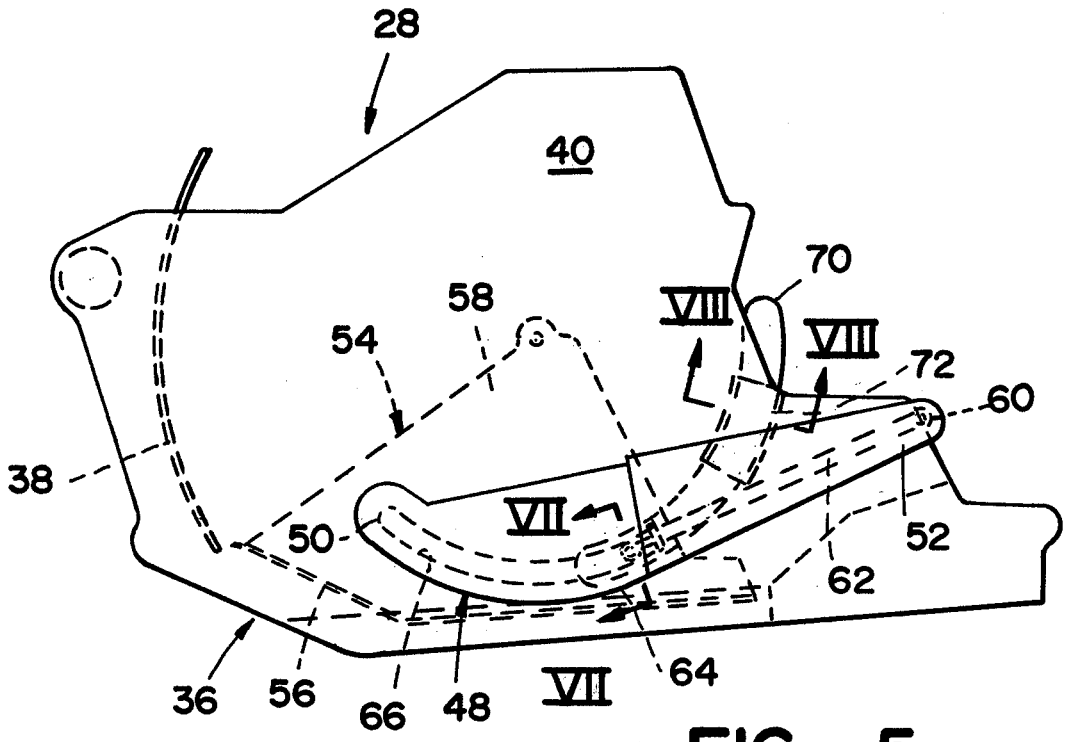
FIGS. 5 and 6 are enlarged views of portions of the apparatus of FIG. 1, showing the operation thereof.
Figure 6:
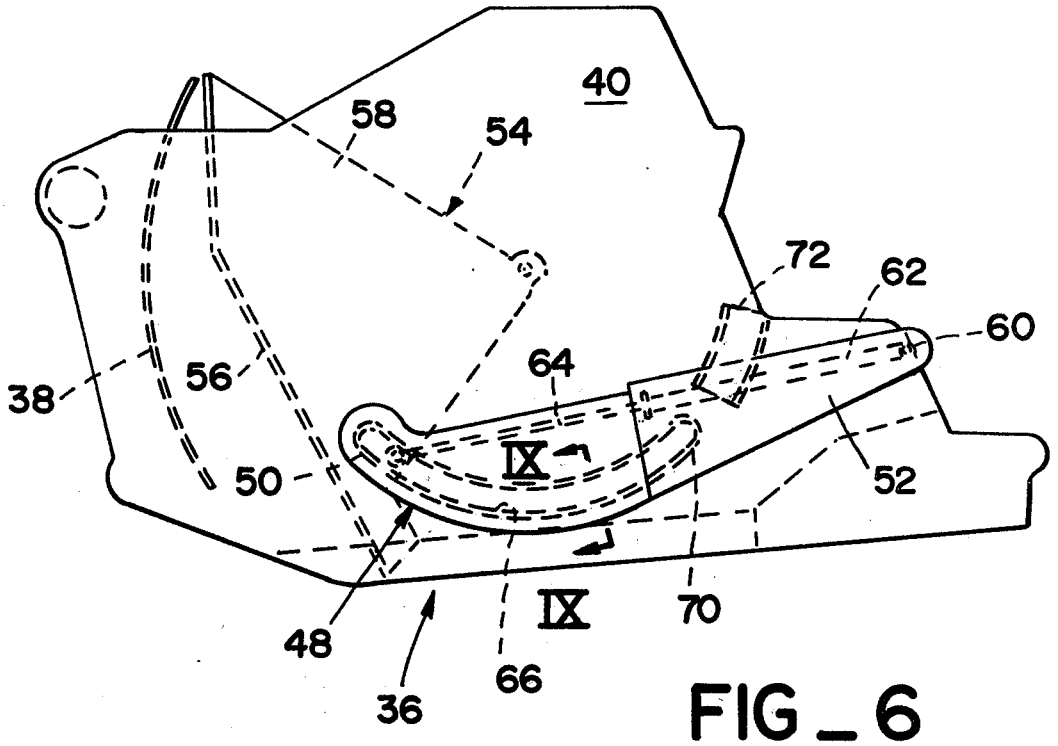

The bowl assembly 28 also includes a single movable bowl portion 54 having a floor 56 interconnecting third and fourth sidewalls (one shown at 58), the third and fourth sidewalls being pivotally mounted to the first and second sidewall means 40, 42 as is well-known. The movable bowl portion 54 can be moved from a forward position defining a closed or carrying state of the bowl assembly 28 wherein floor 56 covers a bottom opening of the bowl assembly to a rearward position defining an open or releasing state of the bowl assembly 28 as shown in FIGS. 5 and 6, respectively. The sidewalls of the movable bowl portion 54 are disposed inwardly of and adjacent the first and second sidewall means 40, 42 respectively.

An actuating means in the form of a double-acting cylinder 59 is operatively associated with the sidewall means 40 and sidewall 58, and a like cylinder (not shown) is operatively associated with the sidewall means 42 and other sidewall of the movable bowl portion 54, so only one of these cylinders and the construction thereof will be described in detail.

Cylinder 59 has the head end 60 of the body 62 thereof pivotally mounted to the sidewall means 40, the body 62 of the cylinder 59 being disposed in the relatively wider portion of the pocket portion 48, between the spaced-apart walls 44, 46, with the rod 64 also being disposed in the pocket portion 48, but in that area where the walls 44, 46 are more closely spaced. In any case, the cylinder 59 is disposed generally between and within the confines of the pair of walls 44, 46. The inner wall 44 of the pair thereof defines an arcuate slot 66 at least generally defined by a radius having its center at the pivotal connection of the movable bowl portion on the bowl assembly, with the rod 64 of the cylinder 59 being connected to the sidewall 58 through the slot 66 by means of a connector 68. An arcuate plate 70 (FIGS. 5 and 6) is secured to the connector 68 so as to be secured relative to the sidewall 58. With the movable bowl portion 54 in its forward, or carrying position, the plate 70 slidably extends into a guide member 72 secured to the sidewall 44, such guide member 72 also being arcuately shaped. With the movable bowl portion 54 in its forward or carrying position, the sidewall 58 covers the slot 66 to provide masking means so as to keep foreign material in the bowl from entering into the slot 66 and into the area of the cylinder 59. As the bowl portion 54 is moved rearwardly to a dump position the plate 70 is moved therewith to provide additional masking means to assure continuous covering of the slot 66, to continue to block foreign material from entering that area.

It will be seen that the cylinder 59 and the other cylinder corresponding thereto extend from the respective sidewalls of the movable bowl portion 54 forwardly of the vehicle 10.

In operation, the cylinders as at 59 may be selectively extended and retracted to provide the bowl portion 54 movements as shown in FIGS. 5 and 6. The cylinders as at 59 are appropriately placed such that there is clearly no interference thereof with the rear engine 16 of differential 18 of the vehicle 10 as previously discussed. Furthermore, the provision of a pair of cylinders, on either side of the movable bowl portion 54, insures that smooth movement of the movable bowl portion 54 relative to the fixed bowl portion 36. Meanwhile, it is insured that appropriate areas of the operating mechanism are blocked at all times from receiving foreign material which might interfere with the overall operation thereof.

The embodiments of the invention in which an exclusive property or privilege is claimed are defined as follows:

1. A bowl assembly for a construction vehicle comprising a pair of laterally spaced first and second sidewalls defining an opening therebelow, a movable bowl portion movably mounted on said bowl assembly for movement between a first position covering said opening and a second position exposing said opening, actuating means at least substantially disposed within the confines of at least one of said first and second sidewalls for selectively moving said bowl portion between its first and second positions, said actuating means connected to said bowl portion through an elongated slot formed through said one sidewall, and masking means for continuously covering said slot upon actuation of said actuating means for moving said bowl portion between its first and second positions.

2. The bowl assembly of claim 1 wherein said actuating means comprises a double-acting cylinder interconnected between said one sidewall and said bowl portion.

3. The bowl assembly of claim 1 wherein a said actuating means is disposed within the confines of each of said first and second sidewalls.

4. The bowl assembly of claim 1 wherein said bowl portion comprises a pair of laterally spaced third and fourth sidewalls pivotally mounted on said first and second sidewalls, respectively, and a floor secured between said third and fourth sidewalls to normally cover said opening when said bowl portion is maintained in its first position.

5. The bowl assembly of claim 4 wherein said actuating means is pivotally interconnected between said one sidewall and a respective one of said third and fourth sidewalls.

6. The bowl assembly of claim 5 wherein said masking means comprises said respective one of said third and fourth sidewalls.

7. The bowl assembly of claim 6 wherein said masking means further comprises a plate secured to said respective one of said third and fourth sidewalls.

8. The bowl assembly of claim 7 further comprising guide means secured to said bowl assembly for guiding sliding movements of said plate therein.

9. The bowl assembly of claim 1 wherein said slot is arcuate and is at least generally defined by a radius having its center at a pivotal connection of said bowl portion on said bowl assembly.

* * * * *